US008419868B2

(12) United States Patent
Lai

(10) Patent No.: US 8,419,868 B2
(45) Date of Patent: Apr. 16, 2013

(54) PROCESS AND METHOD TO INCREASE THE HARDNESS OF FE-CR-C WELD OVERLAY ALLOY

(75) Inventor: George Y. Lai, Carmel, IN (US)

(73) Assignee: Aquilex Holdings LLC, Atlanta, GA (US)

( * ) Notice: Subject to any disclaimer, the term of this patent is extended or adjusted under 35 U.S.C. 154(b) by 516 days.

(21) Appl. No.: 11/690,763

(22) Filed: Mar. 23, 2007

(65) Prior Publication Data

US 2008/0230155 A1 Sep. 25, 2008

(51) Int. Cl.
*C21D 9/50* (2006.01)

(52) U.S. Cl.
USPC ..... 148/529

(58) Field of Classification Search ..... 148/512, 148/529; 420/37
See application file for complete search history.

(56) References Cited

U.S. PATENT DOCUMENTS 3,990,892 A * 11/1976 Machi et al. ..... 420/37
4,015,100 A * 3/1977 Gnanamuthu et al. ..... 148/512

FOREIGN PATENT DOCUMENTS

JP 63103050 A * 5/1988

* cited by examiner

*Primary Examiner* — Weiping Zhu
(74) *Attorney, Agent, or Firm* — Greenberg Traurig, LLP

(57) ABSTRACT

A method of preparing a mechanical component with an Fe—Cr—C hardfacing weld overlay alloy for improving the resistance of the mechanical component to abrasion, erosion or erosion/corrosion for use in very abrasive, erosion or erosive/corrosive environments by significantly increasing the hardness of the weld overlay is disclosed. To improve the resistance to abrasion, erosion or corrosion, a weld overlay of a Fe—Cr—C hardfacing alloy is applied onto the surface of a metallic component, such as tubes, pipes, or vessels. Welding and cladding methods including gas-metal-arc welding (GMAW), gas-tungsten-arc welding (GTAW), and laser cladding may be utilized. Then, the component is heat-treated at elevated temperatures for a sufficient time, resulting in additional hardening and thus further increasing the weld overlay's resistance to abrasion, erosion, or erosion/corrosion.

9 Claims, 3 Drawing Sheets

PROCESS AND METHOD TO INCREASE THE HARDNESS OF FE-CR-C WELD OVERLAY ALLOY

BACKGROUND

1. Field

The present disclosure relates to a process and associated methods to harden a hardfacing weld overlay alloy. More specifically, the present disclosure relates to a heat-treatment process to harden the weld overly of an iron-chromium-carbide hardfacing alloy to significantly improve the resistance of the weld overlay against erosion, abrasion, and erosion-corrosion.

2. General Background

Fe—Cr—C alloy system is a well known hardfacing material. Carbon is needed to form hard particles of carbide to contribute the alloy's resistance to erosion or abrasive wear. More carbon in the alloy forms more volume fraction of carbides, thus exhibiting more resistance to wear. Thus, common hardfacing alloys of this type contain more than 2% carbon. Chromium is added to the alloy to form much more stable chromium carbides instead of less stable iron carbides (if no chromium in the alloy). Chromium is also useful in increasing the alloy's oxidation resistance by forming chromium oxides when the component is intended for services at high temperatures. This group of hardfacing alloys is often referred to as "high-alloy white cast irons". General discussion of this group of hardfacing alloys can be found in ASM Handbook, Vol. 4, Heat Treating, p. 700. The alloys are typically used in forms of castings or hardfacing weld overlays. The large volume of eutectic carbides in the microstructure of a casting or weld overlay provides high hardness for abrasion resistance.

Alloys of various compositions in this group are also subject to heat treatments to produce additional hardening by forming martensite in the alloy. This martensitic phase transformation is a well known phase transformation in Fe—C alloy system by heating the alloy at a high temperature in an austenitic phase range followed by fast cooling to a temperature below the critical temperature, typically referred to as $M_s$ temperature (i.e., the temperature when the martensite phase starts forming at the temperature when the metal is being cooled to room temperature. The hardness of the alloy will significantly be increased when the microstructure of the alloy contains martensite. The $M_s$ temperature varies depending on the composition of the alloy. Some high chromium alloys exhibit such very low $M_s$ temperatures that the alloys have to be cooled well below room temperature in order to produce additional hardening by forming martensite. These alloys are to be refrigerated in order to transform the austenite phase to martensite phase for additional hardening. Typical of such alloys are those described in U.S. Pat. Nos. 3,941,589, 4,547,221, and 5,183,518. U.S. Pat. No. 3,941,589 describes alloy composition comprising 2.5-3.5% carbon, 2.5-3.5% manganese, 12-22% chromium, 1-2% silicon, 1.5-3.0% molybdenum, 1-2% copper, and balance iron. The alloy of this referenced invention is hardened by transformation of some austenite to martensite by a refrigeration heat-treatment involving cooling the metal to a temperature usually below about −100° F. (−75° C.) for a period of time. U.S. Pat. No. 4,547,221 describes alloy composition comprising about 2.6-3.6% carbon, about 12-22% chromium, about 0.5-1.1 manganese, about 1.0-3.0% molybdenum, about 0.5-1.5% copper, about 1.4-2.5% nickel, about 1.4-2.5% silicon, and balance iron. The alloy of this invention is also hardened by a refrigeration heat-treatment involving cooling the metal to a temperature usually below −100° F. (−75° C.) for a period to allow additional austenite to transform to martensite. U.S. Pat. No. 5,183,518 describes alloy composition comprising 2.4-3.8% carbon, 0.4-2.0% manganese, 0.2-1.9% silicon, 0.0-3.0% copper, 1.5-4.5% nickel, 12.0-29.0% chromium, and the remainder iron. The alloy of this invention is hardened by cooling the metal to a cryogenic temperature of about −55° C. (a temperature well below the $M_s$ temperature for the alloy) for a sufficient time to form martensite. Some Fe—Cr—C hardfacing alloys have a much higher $M_s$ temperature, which allows formation of martensite when cooled to room temperature. Typical of such alloys is described in U.S. Pat. No. 6,375,895. U.S. Pat. No. 6,375,895 describes alloy composition comprising about 0.65-1.1% carbon, about 4.5-10.5% chromium, about 0.05-1.0% molybdenum, and balance iron. This hardfacing alloy is suited for welding on the surfaces for protection from abrasion wear. The alloy weld metal can be hardened by forming martensite when cooled down to room temperature.

It is well known that the martensite phase forms when a high-temperature austenite phase in a face-centered cubic structure of steel is cooled to a temperature below $M_s$ temperature to form martensite having a body-centered tetragonal structure with all the carbon atoms being trapped in the structure that produces severe strain in the martensite. As a result, a significant hardening is produced in the metal when martensite is formed. The martensite is not thermally stable. This means when the metal is heated to above $M_s$, which is the temperature martensite starts to form when the metal is being cooled to lower temperatures from an austenitizing temperature, the trapped carbon atoms in the martensite diffuse away from a highly distorted body-centered tetragonal structure that turns into a regular, non-distorted body-centered cubic structure, thus eliminating all the strain in the metal and losing the hardening. The $M_s$ temperature, depending on the alloy chemistry, can be very low for some alloys. For example, $M_s$ temperature of the alloy comprising 2.4-3.8% carbon, 0.4-2.0% manganese, 0.2-1.9% silicon, 0.0-3.0% copper, 1.5-4.5% nickel, 12.0-29.0% chromium, and the remainder iron is below 150° C. (U.S. Pat. No. 5,183,518). Accordingly, the metal that is hardened by martensite cannot maintain its abrasive wear resistance when exposed to elevated temperatures. Furthermore, the high hardness produced by martensite formation is the result of severe strain produced by a distorted crystal structure, not by hard particle phases. Hardness produced this way is not known to exhibit resistance to erosion by the particles-entrained flue gas streams generated in many industrial environments, such as boilers or petrochemical processing.

High alloy white cast irons, which typically contain more than 2% carbon along with chromium and other alloying elements as discussed earlier, contain a large volume of eutectic carbides that provide abrasive wear resistance. These alloys are normally used in castings for machinery in crushing, grinding and other applications for handling abrasive materials. When these alloys are used as a hardfacing, such as a weld overlay, on a metallic component to resist abrasive wear, the weld overlay can develop stress cracks due to large volume of eutectic carbides. In some industrial applications, these stress cracks in the weld overlay may not present performance or safety related issues. However, in some other applications involving pressure boundary components, such as boilers and vessels as well as piping, the weld overlay on these components is to be free of stress cracks. The alloys that are suitable for applications as a weld overlay for these critical components would require a composition containing lower carbon content with lower volume of eutectic carbides.

This will allow the use of welding process to produce a hardfacing weld overlay without developing stress cracks. However, when the volume of eutectic carbides is reduced as a result of lowering carbon content, the alloy's wear resistance is also reduced because of lower hardness. It becomes important that a novel heat-treatment method be developed to further harden a crack-free weld overlay to significantly improve the overlay's resistance to abrasive, erosion wear.

HF35 is a hardfacing alloy comprising about 0.8-1.2% carbon, about 20-23% chromium, about 2.5-3.5% nickel, about 0.2-0.5% zirconium, about 0.5-1.0% molybdenum, about 1.0-2.0% manganese, about 1.0-2.0% silicon, and balance iron along with impurities and incidental elements. The alloy contains much lower carbon as compared with high-alloy white cast irons and other Fe—Cr—C eutectic carbide alloys. The level of chromium in the alloy is (a) to form more stable eutectic chromium carbides (instead of eutectic iron carbides if no or low chromium in the alloy) and (b) to form chromium oxide scales when used at high temperatures to improve oxidation resistance in order to improve the alloy's resistance to erosion/corrosion. Nickel of about 3% is to increase the stability of austenite and improve the alloy's toughness. Additions of other alloying elements, such as molybdenum and zirconium, are intended to further improve the alloy's abrasion, erosion, and erosion/corrosion resistance. Due to much lower carbon content, the volume of eutectic carbides is much reduced, thus resulting in lower hardness. When the alloy is weld overlaid on a component, such as tube, pipe, vessel, or boiler waterwall, the overlay does not develop cracks. However, the alloy's resistance to abrasion or erosion wear is compromised because of its lower hardness. The hardness for the weld overlay of this hardfacing is typically RC 35-40 in the as-overlaid condition.

A hardfacing alloy with hardness of about RC 35-40 is generally considered to be resistant to moderately abrasive and erosive environments. For highly abrasive and erosive conditions, such hardfacing alloy with hardness of about RC 35-40 is not likely to perform well. For example, HF35 overlay tubes were tested as part of the in-bed evaporator tube bundle in a fluidized-bed coal-fired boiler that generates electricity. The overlay tubes were tested for about three years. Two tubes were then removed for evaluation. The examination showed that the HF35 overlay performed well for most of the tube except some localized areas that the overlay was worn off. This localized area was apparently subject to high abrasive and erosive conditions and the HF35 weld overlay, with about RC35-40, was found to be inadequate.

An existing Fe—Cr—C hardfacing alloy weld overlay that can be weld overlaid to a part without stress cracks exhibits only moderate hardness. Thus, there is a need to develop a novel method to further increase the hardness of this moderately hardened hardfacing weld overlay to a level, such as RC50 or higher, such that the weld overlay's resistance to abrasive and/or erosive wear becomes adequate for use in aggressive abrasive and erosive environments.

In a test program trying to determine whether the HF35 overlay would be susceptible to cracking when the overlay was heated to very high temperatures, such as 2000° F., an HF35 overlay tube sample was furnace heated to 2000° F. and held for about one hour followed by furnace cooling to 1600° F. and then removed from the furnace and air cooled to room temperature. It was unexpectedly discovered that the overlay, which exhibited hardness of RC40 before this heat-treatment, was hardened to RC54 after this heat-treatment. This was a significant increase in hardness for the weld overlay produced by this simple heat-treatment. It was also discovered that this heat-treatment did not cause cracking of the hardfacing weld overlay. To see whether air cooling from 1600° F. to room temperature was responsible for this hardening, a sample of another HF35 overlay tube was placed in a 1600° F. furnace and the temperature was increased to 2000° F. by a furnace heat-up. The sample was held at 2000° F. for one hour and then furnace-cooled to 1600° F. and then continued to room temperature by furnace cooling. Significant hardening was also observed by this very slow furnace cooling. Hardness was increased from RC38 in the as-overlaid condition to RC54 after this heat-treatment with very slow furnace cooling. Thus, the hardening was not the result of well-known phase transformation to martensite during cooling to room temperature.

SUMMARY

Fe—Cr—C alloys that contain carbon content lower than about 2.0% such that the hardfacing alloy can be applied as a weld overlay without suffering stress cracks that are commonly encountered in high carbon (more than 2%) Fe—Cr—C hardfacing alloys. This type of lower carbon Fe—Cr—C hardfacing alloy weld overlay typically exhibits moderate hardness (about RC35-40), thus exerting only moderate resistance to erosion and abrasive wear. Thus, there is a strong need to further harden the weld overlay of this type hardfacing alloy after the application of the weld overlay to further increase its hardness to more than RC 50 in order to further increase its erosion and abrasive wear resistance.

In many industrial applications, many components, such as boiler tubes in a coal-fired boiler, are a pressure boundary, and a weld overlay that is applied to these components for erosion and/or abrasive resistance is required to be crack-free in order to avoid the propagation of the crack into this pressure boundary component potentially causing fatalities and injuries. Most Fe—Cr—C hardfacing alloys contain more than 2% carbon readily develop stress cracks when applied as a weld overlay. However, when carbon is reduced to a lower level to allow weld overlays of this group of hardfacing alloys to be applied, the hardness of the weld overlay was significantly reduced, thus resulting in significantly lower erosion and abrasive resistance. Thus, it is critically important that a method be provided to harden the weld overlay after it is applied to significantly increase its hardness to a more useful range through a simple heat-treatment.

In the present disclosure, there is provided a heat-treatment method by heating the weld overlay of this type of hardfacing alloy to a temperature of 2000° F. followed by air cooling or very slow furnace cooling will cause the hardness of HF35 weld overlay to increase from about RC 38 to RC 54. Both air cooling and very slow furnace cooling produced the same degree of hardening. This hardening is not the result of a well-known phase transformation involving formation of martensite and/or bainite observed in prior art involving Fe—Cr—C hardfacing alloys.

Heat treatments to 1800° F. and 1600° F., followed by air cooling produced a hardness increase to RC57 and RC56, respectively. The 1400° F. heat treatment produced somewhat lower hardening with a hardness increase to about RC51. Heat treating to 1200° F. produced no hardening is produced. The hardness of the weld overlay remained RC38, essentially same as that of as-overlaid condition.

The optimum heat treatment temperature is 1600° F. followed by air cooling. This will have less energy consumption by heat treating at the lowest temperature and less oxidation for substrate steels when heated to high temperatures. Heat treatment to 1400° F., although not achieving the same degree of hardening as compared with higher temperature heat-treatments, still results in quite substantial hardening. The heat treatment at 1400° F. makes the field heat-treatment possible when the overlay is applied in the field in such components as vessels and piping.

The range of hardening temperatures in the present disclosure is summarized in FIG. 2. For HF35 weld overlay, hardening occurs at the heat-treatment temperatures of 1400° F. and higher, and up to 2000° F. At temperatures of 1600 to 2000° F., no significant differences in the degree of hardening. The temperature of 1600° F. is the optimum heat-treatment temperature in terms of energy savings and the least oxidation attack on substrate carbon or low alloy steels during the heat-treatment cycle. No hardening was observed at low heat-treatment temperatures, such as 1200° F.

The hardening obtained by heat-treatments in the present disclosure is not the result of a well-known hardening mechanism of martensite or bainite formation during cooling from the heat-treatment temperature. The hardening is the result of the formation of hard particles in the grain matrix at heat treating temperatures from 1400-2000° F. This is illustrated by comparing the microstructure of the as-overlaid HF35 weld overlay consisting of only eutectic carbide phases along the interdendritic boundaries, as shown in FIG. 3, and that of the heat-treated overlay consisting of not only eutectic carbide phases along interdendritic boundaries but also hard precipitate phases within grain matrix, as shown in FIG. 4. These hard precipitate phases that form within the grain matrix during the heat-treatment are believed to be responsible for the additional hardening during the heat-treatment.

BRIEF DESCRIPTION OF DRAWINGS

The foregoing aspects and advantages of present disclosure will become more readily apparent and understood with reference to the following detailed description, when taken in conjunction with the accompanying drawings, wherein.

DETAILED DESCRIPTION

In power boilers, carbon or low alloy steels are typical construction materials for furnace boiler tube waterwalls and superheaters/reheaters in the convection section. The outer surface of these tubes is subject to high temperature corrosive combustion products, particulate erosive matter, thermal cycling and other hostile conditions. As a result of these aggressive boiler operating conditions, carbon and low alloy steel tubes suffer high wastage rates, thus requiring frequent replacements in many critical areas. Frequent shutdowns for the boiler due to materials problems can pose a serious issue of boiler availability and maintenance cost if protection methods are not utilized.

Figure 1:
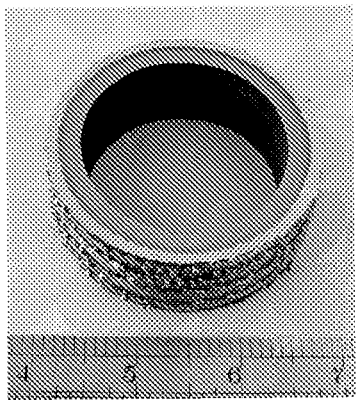
FIG. 1 illustrates the cross-section of a HF35 overlay tube sample consisting of an outer layer of HF35 overlay on a carbon steel tube
Figure 2:
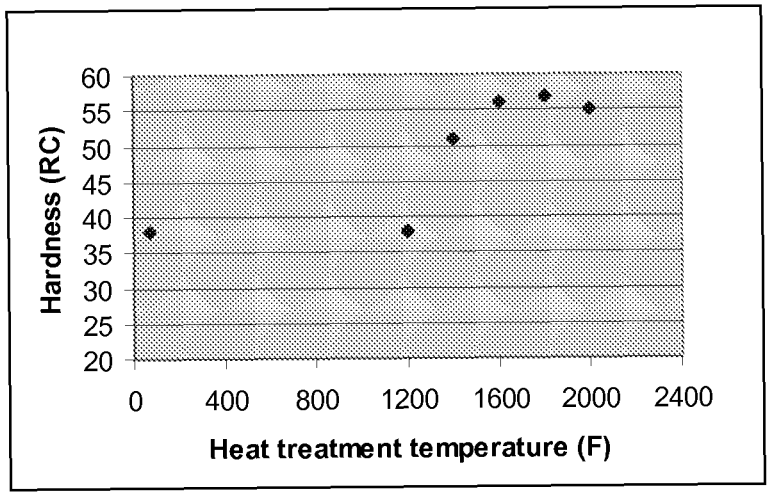
FIG. 2 illustrates the hardness (RC) of the weld overlay of HF35 hardfacing alloy as a function of the heat-treatment temperatures (1200, 1400, 1600, 1800 and 2000° F.) as compared with the as-overlaid condition indicated here as 70° F.
Figure 3:
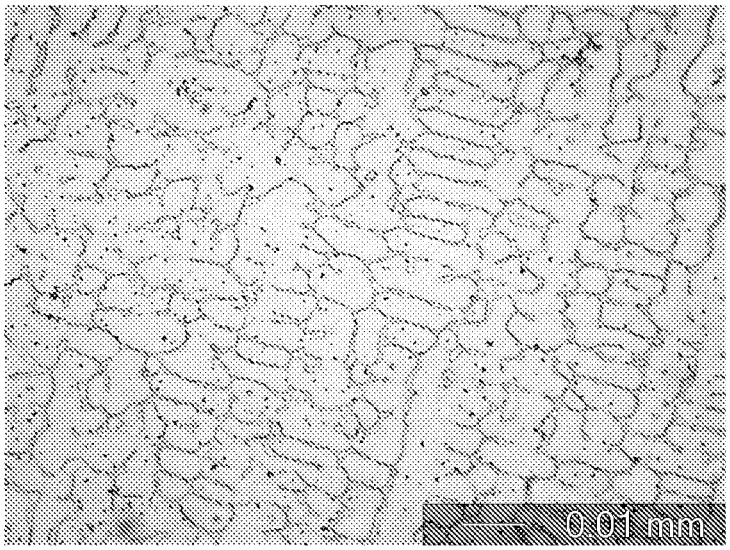
FIG. 3 illustrates the microstructure of the as-overlaid HF35 overlay (RC38) before the heat-treatment, showing eutectic carbide phases formed along interdendritic boundaries. Original magnification: 1000× (1000 times).
Figure 4:
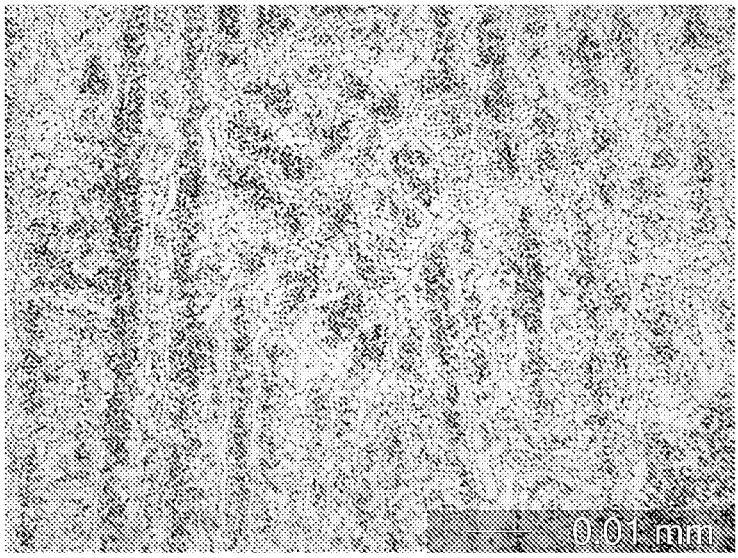
FIG. 4 illustrates microstructure of the HF35 overlay (RC54) after the heat-treatment at 2000° F. for one hour, showing numerous precipitates (dark particles) formed within the grain matrix. The eutectic carbide phases formed along intedendritic boundaries.
Figure 5:
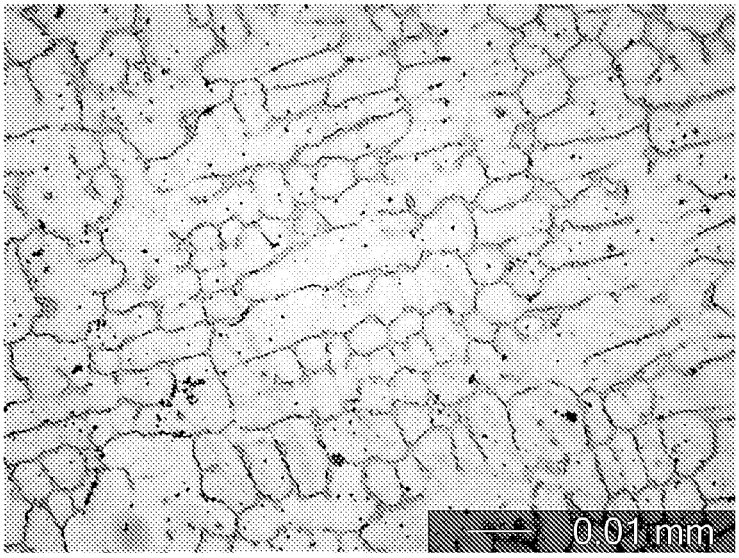
FIG. 5 illustrates microstructure of the HF35 weld overlay after heat-treatment to 1200° F., showing no precipitates formed within the grain matrix and thus no additional hardening by the heat treatment.

One cost-effective protection method for these boiler tubes is to use weld overlay tubes in those critical areas where unprotected carbon or low alloy steels suffer a short service life. The weld overlay is made by applying a corrosion- or erosion/corrosion-, or erosion-resistant weld overlay onto a carbon or low alloy steel tube. The overlay is typically applied onto a rotating tube using a gas-metal-arc (GMAW) welding method. The overlay applied in this spiral mode exhibits a uniform overlay around the tube circumference on the outer diameter of the tube. Thus, the weld overlay is capable of providing the needed resistance to corrosion, erosion-corrosion, or erosion for the boiler tubes in power boilers. The type of weld overlay alloy applied will depend on the nature of the tube wastage mechanism and the type of the boiler. For the area that requires an overlay for erosion or abrasion resistance, a hardfacing overlay material, such as HF35 alloy, would be required for the weld overlay. FIG. 1 shows a cross-section of a HF35 weld overlay tube. The weld overlay is applied onto the outer diameter surface of a tube. In refinery or petrochemical plants, the inner diameter (ID) of the tube or pipe may suffer corrosion, or erosion-corrosion, or erosion attack. Under these conditions, the weld overlay can also be applied on the ID surface of the tube or pipe. The manufacturing of weld overlay tubes is typically performed by overlay welding with water cooling in order to minimize the distortion of the tube from the heat input by welding. Overlay welding can also be applied onto a waterwall panel that consists of tubes with membranes connecting adjacent tubes. Field application of a weld overlay on the waterwall of a boiler or the wall of a pressure vessel is also routinely performed. The waterwalls surround the furnace and consist of a series of tubes with membranes connecting adjacent tubes. Water inside the tubes converts the heat generated in the furnace to high pressure steam for power generation. Overlay welding can be applied using automatic welding machines or by manually using a semi-automatic machine. Overlay welding can also be performed without water cooling when such set-up is not possible. Overlay welding can be applied using gas-metal-arc welding (GMAW), gas-tungsten-arc welding (GTAW), or other welding and cladding methods including Laser cladding and melting. Other arc welding methods may include submerged arc welding, electrostag welding and plasma transfer arc welding. The hardfacing alloys can also be manufactured in castings.

HF35 alloy is a Fe—Cr—C hardfacing weld wire comprising about 0.8-1.2% carbon, 1.0-2.0% manganese, 1.0-2.0% silicon, 20.0-23.0% chromium, 2.5-3.5% nickel, 0.2-0.5% zirconium, 0.5-1.0% molybdenum, and the balance iron along with residual elements and incidental impurities. The HF35 weld overlay of a weld overlay tube, which is produced by spiral overlay welding with component water cooling (FIG. 1), typically contains about 1% carbon, about 19% chromium, about 2.5% nickel, about 0.5% molybdenum, about 1.4% manganese, about 1.2% silicon, about 0.3% zirconium, and balance iron.

In trying to determine whether the HF35 overlay would be susceptible to cracking when the overlay was heated to very high temperatures, such as 2000° F., an HF35 overlay tube sample was heated to 2000° F. by first placing the sample in the 1600° F. furnace and then furnace-heated to 2000° F. The sample was then held inside the furnace at 2000° F. for about one hour, followed by furnace cooled to 1600° F. and then removed from the furnace and air cooled to room temperature. It was unexpectedly discovered that the HF35 overlay, which exhibited hardness of RC40 before this heat-treatment, was hardened to RC54 after this heat-treatment. Examination of the microstructure of the hardened HF35 weld overlay after the 2000° F. heat-treatment revealed fine precipitate particles formed in the matrix in addition to the eutectic carbides that formed along the interdendritic boundaries. These fine precipitate particles were not in the as-weld overlay sample prior the heat-treatment. It is, thus, believed that these fine precipitate particles were responsible for additional hardening during the 2000° F. heat-treatment.

In order to confirm this unexpected discovery, another sample of HF35 overlay tube was subjected to the same heat-treatment as that stated in Paragraph [0028] (i.e., the sample was placed in the 1600° F. furnace, furnace-heated to 2000° F., held for one hour at the temperature, then furnace-cooled to 1600° F. followed by removing the sample from the furnace and air cooling it to room temperature. It was found that the hardness of the HF35 weld overlay was increased from RC 38 in the as-overlaid condition to RC 55 after the heat-treatment, thus essentially confirmed the previous unexpected discovery. The microstructure of this heat-treated weld overlay also showed precipitation of numerous fine particles in the matrix, similar to the microstructure observed in the earlier sample described in Paragraph [0028].

In order to determine whether the hardening occurred during air cooling from 1600° F. following the furnace cooling from 2000° F., another HF35 weld overlay tube sample, which was cut from the same HF35 weld overlay tube in the heat-treatment study described in Paragraph [0029], was placed in the 1600° F. furnace, furnace-heated to 2000° F., and held the sample for one hour at 2000° F., followed by a slow furnace cooling to room temperature by shutting off the furnace power. This slow furnace cooling would essentially eliminate any possibilities of forming martensite or bainite phases during cooling. The average hardness of the weld overlay after this slow furnace cool was found to be RC 54 (RC 56, 53, 53, and 53 across the overlay). The additional hardening was essentially same as the sample from air cooling, as described in Paragraph 0030.

Additional heat-treatments were performed to determine the temperature range that the hardening can occur. If the lower heat-treatment temperature can achieve the same hardening as was resulted from 2000° F. heat-treatment, energy saving can be resulted from a lower heat-treatment temperature. HF35 weld overlay tube samples were subjected to the following heat-treatments: 1800° F. for one hour followed by air cool, 1600° F. for one hour followed by air cool, 1400° F. for one hour followed by air cool, and 1200° F. for one hour followed by air cool. The average hardness of the weld overlay was found to be RC 57 (RC 57, 58, 56, and 56 across the overlay) heat-treated at 1800° F., RC 56 (RC 57, 56, 57, and 54 across the overlay) heat-treated at 1600° F., RC 51 (RC 56, 51, 50, and 48 across the overlay) heat-treated at 1400° F., and RC 38 (RC 39, 39, 37, and 36 across the overlay) heat-treated at 1200° F. The results show that heat treating at 1200° F. did not result in additional hardening. For additional hardening, temperatures higher than 1200° F. are required. Heat treating at 1400° F. shows some hardening, but for full hardening, temperatures higher than 1400° F. would be needed. The current heat treatment studies show that heat-treatments at 1600, 1800, and 2000° F. produced full hardening for HF35 weld overlay. The optimum heat treatment temperature in shop would be 1600° F. For field heat-treatments, the temperature can be 1400° F. or possibility of 1300° F. These low heat-treatment temperatures (i.e., 1400° F. or possibly 1300° F.) make the hardening heat-treatment possible in the field.

The compositional ranges for the Fe—Cr—C hardfacing alloy that is likely to produce additional hardening by the present heat-treatment disclosure are 0.5-2.0% carbon, 10-30% chromium, 1.0-8.0% nickel, 0.2-0.5% zirconium, 1.0-2.0% manganese, 0.5-3.0% silicon, 0.5-3.0% molybdenum, 0.0-3.0% tungsten, 0.0-0.5% boron, and balance iron along with impurities and incidental elements.

Table 1 shows the composition HF35 alloy. Also shown in the table is the exemplary compositional range of Fe—Cr—C hardfacing alloy that may also be utilized with the disclosed process.

TABLE 1

Nominal Chemical Composition in Weight Percent

| ELEMENT | HF35 COMPOSITIONAL RANGE (WT. %) | EXEMPLARY COMPOSITIONAL RANGE FOR DISCLOSED ALLOY (WT. %) |
|---|---|---|
| C | 0.8-1.2 | 0.5-2.0 |
| Cr | 20.0-23.0 | 10.0-30.0 |
| Ni | 2.5-3.5 | 1.0-8.0 |
| Mn | 1.0-2.0 | 1.0-2.0 |
| Si | 1.0-2.0 | 0.5-3.0 |
| Zr | 0.2-0.5 | 0.2-0.5 |
| Mo | 0.5-1.0 | 0.5-3.0 |
| W | — | 0.0-3.0 |
| B | — | 0.0-0.5 |
| Fe | Balance | Balance |

In other embodiments of the detailed disclosure, there exist other alloy compostions deviating either higher or lower than the compositions listed in Table 1 also benefiting from the heat treatments of the disclosed process.

While the above description contains many particulars, these should not be consider limitations on the scope of the disclosure, but rather a demonstration of embodiments thereof. The weld overlay hardening process and uses disclosed herein include any combination of the different species or embodiments disclosed. Accordingly, it is not intended that the scope of the disclosure in any way be limited by the above description. The various elements of the claims and claims themselves may be combined in any combination, in accordance with the teachings of the present disclosure, which includes the claims.

The invention claimed is:

1. A method of improving the resistance of a mechanical component to abrasion, erosion or erosion/corrosion for use in very abrasive, erosion or erosive/corrosive environments, comprising:

(a) applying a weld overlay of a Fe—Cr—C hardfacing alloy onto the surface of a metallic component using welding and cladding methods; and (b) heat-treating the weld overlay and component at a temperature between about 1400 to 2000 degrees Fahrenheit for about one hour, resulting in additional hardening of the weld overlay to a final hardness of between Rockwell C-50 to C-60 increasing the weld overlay's resistance to abrasion, erosion, or erosion/corrosion;

wherein the hardfacing alloy comprises 10-30% chromium; the cooling from the heat-treatment temperature is furnace cooled or air cooled at a rate slow enough to eliminate the forming of martensite or bainite phases during cooling; and the hardening resulting from the heat-treating is not a result of martensite or bainite formation during cooling from the heat-treating.

2. The method of claim 1 wherein the Fe—Cr—C hardfacing alloys are produced in castings.

3. The method of claim 1 wherein a HF35 hardfacing alloy wire is utilized for preparing the weld overlay, the HF35 hardfacing alloy wire comprises about 0.8-1.2% carbon, about 20-23% chromium, about 2.5-3.5% nickel, about 0.2-0.5% zirconium, about 0.5-1.0% molybdenum, about 1.0-2.0% manganese, about 1.0-2.0% silicon, and balance iron along with impurities and incidental elements.

4. The alloy of claim 1 wherein an initial hardness of the weld overlay in the as-overlaid condition is between Rockwell C-35 and C-40 and said final hardness of between Rockwell C-50 and C-60 is achieved after the heat-treatment.

5. The method of claim 1 wherein a hardfacing alloy wire is utilized for preparing the weld overlay, the hardfacing alloy wire is an alloy composition within the following chemical compositional ranges: about 0.5-2.0% carbon, about 10-30% chromium, about 1.0-8.0% nickel, about 0.2-0.5% zirconium, about 1.0-2.0% manganese, about 0.5-3.0% silicon, about 0.5-3.0% molybdenum, about 0.0-3.0% tungsten, about 0.0-0.5% boron, and balance iron along with impurities and incidental elements.

6. The method of claim 1 wherein the weld overlay is applied to pressure boundary components including tubes, pipes, and vessels.

7. The method of claim 1 wherein the weld overlay is applied using gas-metal-arc welding (GMAW), or gas-tungsten-arc welding (GTAW).

8. The method of claim 1 wherein the weld overlay is applied using arc welding methods selected from the group of submerged arc welding, electrostag welding and plasma transfer arc welding.

9. The method of claim 1 wherein the weld overlay is applied using laser cladding.

* * * * *